US009909487B2

(12) United States Patent
Davies et al.

(10) Patent No.: US 9,909,487 B2
(45) Date of Patent: Mar. 6, 2018

(54) SYSTEMS AND METHODS FOR AN ENGINE COOLING SYSTEM EXPANSION RESERVOIR

(71) Applicant: Ford Global Technologies, LLC, Dearborn, MI (US)

(72) Inventors: David Bryn Davies, Chelmsford (GB); Cliff Pountney, Chelmsford (GB); Hamish MacWillson, Coggeshall (GB)

(73) Assignee: Ford Global Technologies, LLC, Dearborn, MI (US)

( * ) Notice: Subject to any disclaimer, the term of this patent is extended or adjusted under 35 U.S.C. 154(b) by 330 days.

(21) Appl. No.: 14/682,854

(22) Filed: Apr. 9, 2015

(65) Prior Publication Data

US 2015/0308326 A1 Oct. 29, 2015

(30) Foreign Application Priority Data

Apr. 24, 2014 (GB) ..... 1407223.5

(51) Int. Cl.
*F01P 7/16* (2006.01)
*F01P 11/02* (2006.01)
*F01P 7/14* (2006.01)

(52) U.S. Cl.
CPC ..... *F01P 11/029* (2013.01); *F01P 2007/146* (2013.01)

(58) Field of Classification Search
CPC .... F01P 11/029; F01P 3/00; F01P 3/12; F01P 3/20; F01P 2007/146; F01P 7/165
USPC ..... 123/41.29, 41.51
See application file for complete search history.

(56) References Cited

U.S. PATENT DOCUMENTS 4,371,382 A * 2/1983 Ross ..... B01D 3/30 159/49
5,884,588 A * 3/1999 Ap ..... F01P 11/20 123/41.14
6,929,189 B2 8/2005 Takei et al.
7,631,619 B2 * 12/2009 Bangert ..... F01P 11/028 123/41.54
8,251,024 B2 * 8/2012 Hutchins ..... F01P 11/029 123/41.54
8,291,870 B2 * 10/2012 Moffat ..... F01P 3/12 123/196 AB (Continued)

FOREIGN PATENT DOCUMENTS

EP 1197645 B1 7/2007
FR 2915516 B1 * 4/2013 ..... B01D 19/0042

(Continued)

*Primary Examiner* — Grant Moubry
(74) *Attorney, Agent, or Firm* — Greg Brown; McCoy Russell LLP

(57) ABSTRACT

Methods and systems are provided for an expansion reservoir for an engine cooling system. In one example, a cooling system may include a first cooling circuit and a second cooling circuit, the second cooling circuit configured to operate at a different temperature than the first cooling circuit, wherein the expansion reservoir is configured to receive coolant from and return coolant to the first and second cooling circuits. The expansion reservoir may further comprise one or more valves arranged so as to control the flow of coolant from the second cooling circuit to the expansion reservoir and/or from the expansion reservoir to the second cooling circuit depending on the temperature of the coolant.

20 Claims, 5 Drawing Sheets

(56) References Cited

U.S. PATENT DOCUMENTS

| | | | | |
|---|---|---|---|---|
| 8,408,165 | B2 * | 4/2013 | Moffat | F01P 3/12 123/41.05 |
| 8,601,986 | B2 * | 12/2013 | Faulkner | F01P 3/12 123/41.29 |
| 8,607,746 | B2 * | 12/2013 | Hutchins | B01D 19/0036 123/41.54 |
| 2007/0034365 | A1 | 2/2007 | Ringholz | |
| 2008/0190597 | A1 | 8/2008 | Pantow | |

FOREIGN PATENT DOCUMENTS

| | | | | |
|---|---|---|---|---|
| FR | 2993513 | A1 * | 1/2014 | F01P 11/028 |
| JP | 63065116 | A * | 3/1988 | F01P 11/06 |
| WO | WO 2004001204 | A1 * | 12/2003 | F01P 11/028 |
| WO | WO 2008107788 | A1 * | 9/2008 | F01P 7/16 |

* cited by examiner

SYSTEMS AND METHODS FOR AN ENGINE COOLING SYSTEM EXPANSION RESERVOIR

CROSS REFERENCE TO RELATED APPLICATIONS

The present application claims priority to Great Britain Patent Application No. 1407223.5, entitled "AN ENGINE COOLING SYSTEM EXPANSION RESERVOIR," filed on Apr. 24, 2014, the entire contents of which is hereby incorporated by reference for all purposes.

FIELD

The present description relates to an expansion reservoir for an engine cooling system.

BACKGROUND/SUMMARY

Vehicle cooling systems are becoming more complicated with the need to cool components, such as water cooled charge air coolers, automatic transmission coolers and hybrid vehicle coolers, at temperatures below which a normal engine cooling system runs. As a result of the need for colder coolant temperatures, these components are very often cooled by a separate cooling circuit. Such a separate cooling circuit is typically provided with coolant from an electric water pump and a dedicated heat exchanger.

In addition, the separate cooling circuit may comprise a separate expansion reservoir, which may provide a volume for the coolant to expand and deaerate into. The expansion reservoir may also provide a location to fill the coolant in the separate cooling circuit. However, separate coolant reservoirs may require additional fill equipment which may increase the cost and complexity of such cooling systems. Further, it is inconvenient for a vehicle user to have to monitor and fill up separate expansion reservoirs.

Accordingly, some previously-proposed dual temperature cooling systems have a single expansion reservoir. Both a higher temperature cooling circuit (for engine cooling) and a low temperature cooling circuit (for the water cooled charge air coolers, batteries, etc.) are linked by a connecting hose to allow filling of both circuits. However, the inventors herein have recognized potential issues with such systems, mainly due to the transfer of heat from one circuit to another. For example, the coolant in the low temperature circuit may be warmed resulting in higher temperatures than desired and thereby impairing the performance of dependant systems. Similarly, the coolant in the main engine cooling circuit may be cooled by the interaction with the low temperature circuit. This interaction may degrade heater performance and engine fuel economy.

In one example, the issues described above may be at least partially addressed by an engine cooling system comprising: an expansion reservoir, a first cooling circuit and a second cooling circuit, the second cooling circuit configured to operate at a different, e.g., lower, temperature than the first cooling circuit, wherein the expansion reservoir is configured to receive coolant from and return coolant to the first and second cooling circuits, wherein the expansion reservoir comprises one or more valves arranged so as to control, e.g., selectively restrict, the flow of coolant from the second cooling circuit to the expansion reservoir and/or from the expansion reservoir to the second cooling circuit depending on the temperature of the coolant.

As another example, the first and second cooling circuits may be in fluidic communication with each other via the expansion reservoir. However, the one or more valves of the expansion reservoir may substantially prevent flow between the expansion reservoir and one of the first and second cooling circuits when the coolant temperature exceeds a threshold value. As a result, the fluidic communication and thus thermal communication between the first and second cooling circuits may be restricted. As such, warming of the coolant in the cooler, second cooling circuit may be reduced. Thus, the cost, size, and complexity of the cooling system may be increased, while the efficiency may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
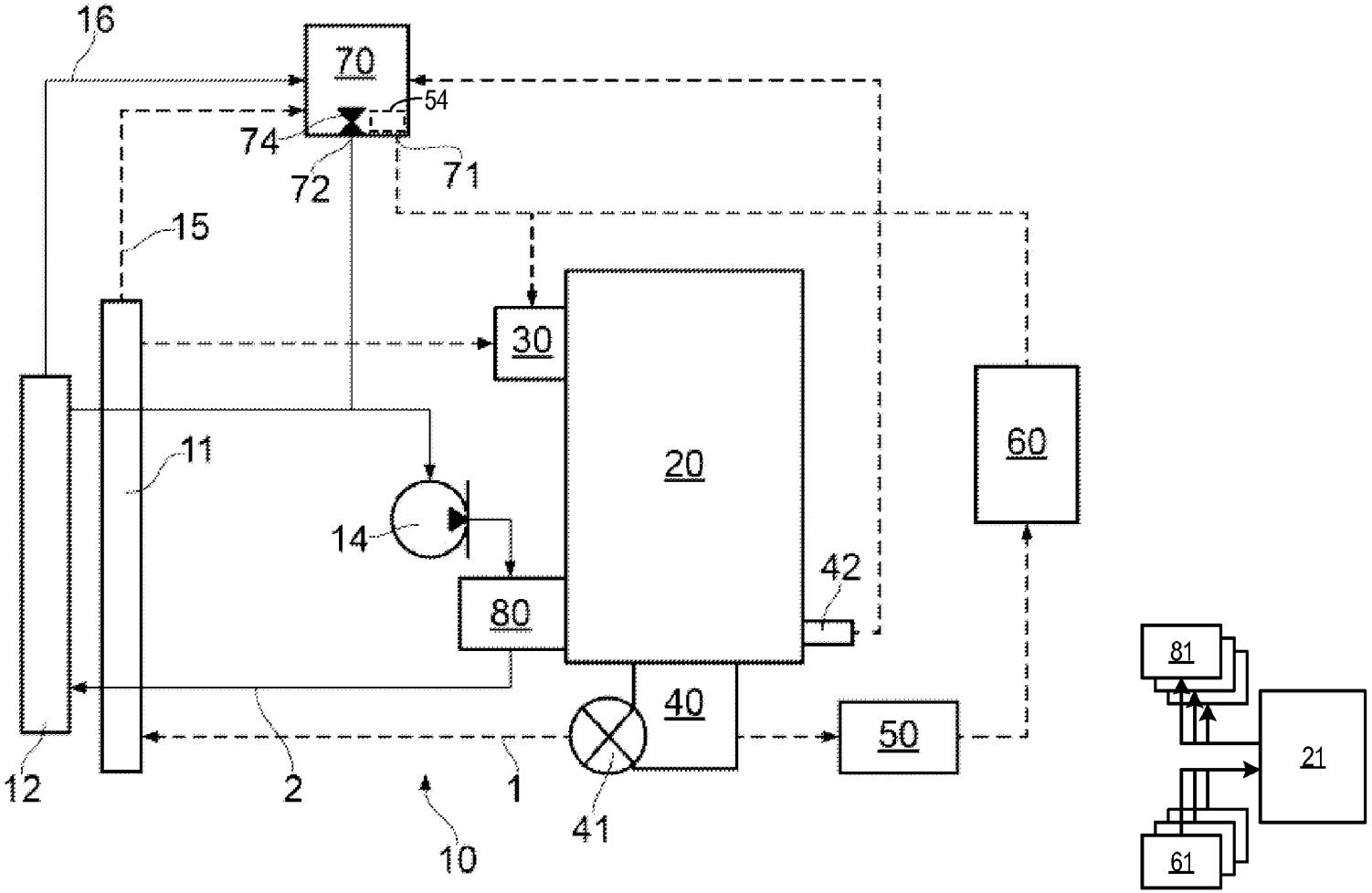
FIG. 1 is a schematic of an example engine cooling system.

An engine may be cooled by an engine cooling system as shown in FIG. 1. Specifically, a coolant may be circulated through the cooling system to cool the engine, and various components of the engine such as a charge air cooler. Further, the coolant may be cooled by two separate cooling circuits, where the two circuits may be designed to cool the coolant to different temperatures. The circuits may be radiators, designed to cool the coolant by blowing air past the coolant with one or more fans. A first circuit may cool the coolant to a first threshold temperature, while a second circuit may cool the coolant to a second threshold temperature, the first threshold being higher than the second threshold. Coolant may be stored, and refilled by a vehicle user in an expansion reservoir.

Figure 2:
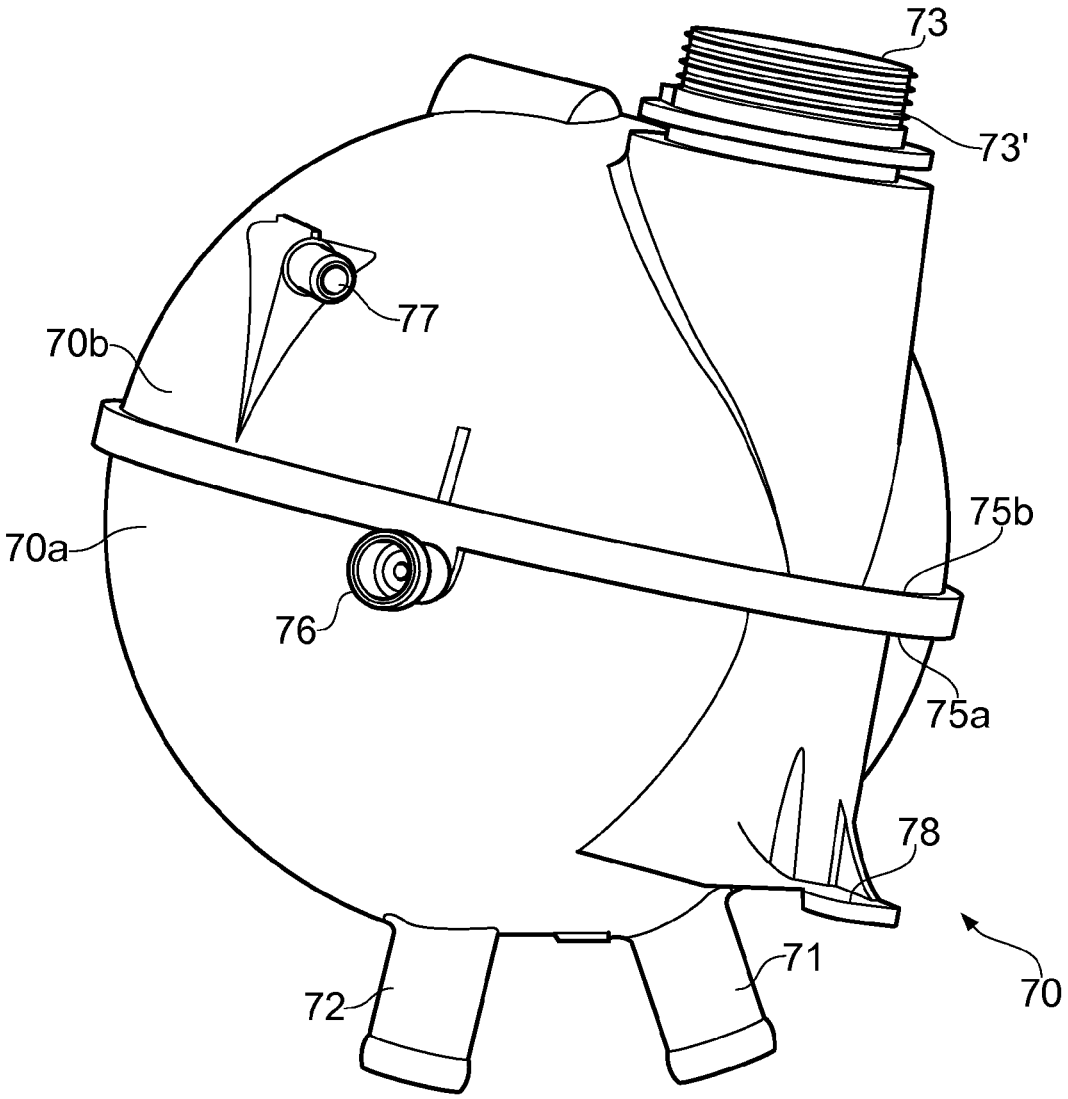
FIG. 2 is a side perspective view of an expansion reservoir of an engine cooling system.

The expansion reservoir, as shown in the example of FIG. 2, may be fluidly coupled to each of the two cooling circuits through a respective coolant line. Coolant may recirculate to the expansion reservoir after passing through one of the cooling circuits to deaerate. Since coolant from the first circuit may reach higher temperatures than desired by the second circuit, a valve in the expansion reservoir, such as the valve shown in FIGS. 3 and 4, may selectively restrict the flow of coolant between the expansion reservoir and the second cooling circuit when the coolant in the expansion reservoir reaches a threshold temperature. As described in the method of FIG. 5, the position of the valve may be adjusted based on the temperature of the coolant in the expansion reservoir. As such, the thermal transfer between the two coolant circuits may be reduced. Therefore, there overall efficiency of the cooling system may be increased.

With reference to FIG. 1, the present disclosure relates to a cooling system 10 for cooling an internal combustion engine 20 of a vehicle. As depicted, the cooling system 10 comprises a first cooling circuit 1 with a first radiator 11 and a second cooling circuit 2 with a second radiator 12. The first radiator 11 is configured to cool the coolant to a first temperature and the second radiator 12 is configured to cool the coolant to a second temperature, which in a particular example is lower than the first temperature. For example, in normal running conditions, the coolant in the first cooling circuit 1 may reach approximately 120° C. by the time it returns to the first radiator 11. By contrast, the coolant in the second coolant circuit 2 may reach approximately 60° C. by the time it returns to the second radiator 12. (The dashed and solid lines in FIG. 1 denote coolant flow paths in the first and second cooling circuits 1, 2 respectively, e.g., with coolant at approximately the first and second temperatures respectively.)

As is depicted, coolant in the first cooling circuit 1 from the first radiator 11 may enter the internal combustion engine 20 through a pump 30 and leave through an engine outlet 40. Coolant exiting the engine outlet 40 may return to the pump 30 via the first radiator 11. A thermostat 41 may be provided at the engine outlet 40 and the thermostat 41 may selectively restrict or prevent flow to the first radiator 11 depending on the temperature of the coolant. The coolant may also be returned to the pump 30 via an Exhaust Gas Recirculation (EGR) cooler 50 and/or a cabin heater 60 arranged in flow series. Coolant may also exit the engine 20 at a further outlet 42 and pass through an expansion reservoir 70 before being returned to the pump 30. The coolant may return from the expansion reservoir 70 to the first coolant circuit 1 via a first expansion reservoir outlet 71. In addition, coolant may flow from the first radiator 11 to the expansion reservoir 70 via a first flow path 15, which may be in the form of a flexible hose.

The expansion reservoir 70 may provide a volume for the coolant to expand into. The expansion reservoir 70 may also provide a location for the coolant level to be monitored and for the cooling system to be filled up with coolant if necessary. The coolant may only partially fill the expansion reservoir, with the rest of the volume being occupied by air. As such, the expansion reservoir 70 may be provided at or towards the highest point in the first and second cooling circuits 1, 2. Excess gas in the coolant may escape from the liquid coolant in the expansion reservoir 70. Accordingly, the expansion reservoir 70 may also be referred to as an expansion tank, a reserve tank, a fill-up tank, a coolant bottle and/or a degas bottle.

A charge air cooler 80 may be provided in the second coolant circuit 2 with coolant from the second radiator 12 cooling the charge air cooler 80. The coolant may comprise water, in which case the charge air cooler 80 may be a Water Cooled Charge Air Cooler (WCCAC). Other devices (not shown) may also be provided in the second coolant circuit 2. A pump 14 may be provided in flow communication with an outlet of the second radiator 12. The pump 14 may pump the flow of the coolant leaving the second radiator 12 to the charge air cooler 80. The pump 14 may be an electric pump and as such the pump may be powered by a vehicle battery and/or alternator. By contrast, the pump 30 may be driven by a crankshaft of the engine. However, one or more of pump 14, and pump 30 may be powered by one or more of an electric motor and the engine crankshaft.

The second coolant circuit 2 may also be in fluidic communication with the expansion reservoir 70. For example, coolant may flow from the second radiator 12 to the expansion reservoir 70 via a second flow path 16, which may be in the form of a flexible hose. Coolant may leave the expansion reservoir 70 via a second expansion reservoir outlet 72 to return to the second cooling circuit 2, for example at a point in the coolant flow path between the second radiator 12 and the pump 14.

As shown in FIG. 1, the expansion reservoir 70 may be separate and spaced apart from the other components in the cooling system 10. Accordingly, the expansion reservoir 70 may be fluidly connected to the other components in the cooling system 10 by ducts, hoses, pipes etc.

It will be apparent from the above that the expansion reservoir 70 is in fluidic communication with both the first and second cooling circuits 1, 2. However, to limit the commingling of the coolant from the first and second coolant circuits and thus the transfer of thermal energy from the hotter first coolant circuit 1 to the cooler second coolant circuit 2, a valve 74 may be provided in the second outlet 72. The valve 74 is configured to selectively restrict, e.g. prevent, the flow of coolant from the expansion reservoir 70 to the second cooling circuit 2. Thus, valve 74 may be adjusted between a first position where coolant flows between the expansion reservoir 70 and the second cooling circuit 2, and a second position where the coolant does not flow between the expansion reservoir 70 and the second cooling circuit. In the description provided herein, "open" and "closed" may be used to refer to the first and second positions, respectively. The valve 74 opens or closes depending on the temperature of the coolant in the expansion reservoir 70.

For example, the valve 74 is configured such that the valve is open when the temperature of the coolant is below a threshold value and that the valve is closed when the temperature of the coolant is above the threshold value. As a result, the fluidic and thus thermal communication between the first and second cooling circuits may be restricted when the coolant temperature is above the threshold value and when heat transfer between the two circuits 1, 2 may have otherwise been greatest. In one embodiment, the valve 74 may be a passively controlled valve. As such, the valve may comprise a temperature sensitive element, such as wax, which may adjust the position of the valve in response to changes in the temperature of the coolant in the expansion reservoir 70. Specifically, when the coolant temperature exceeds a non-zero threshold, the valve may move into the second position, so that coolant does not flow between the expansion reservoir 70 and the second cooling circuit 2. In another embodiment, the valve 74, may be an electronically controlled valve (e.g., actively controlled), and the position of the valve may be controlled by a controller 21.

The expansion reservoir 70 may additionally comprise a temperature sensor 54, positioned within the expansion reservoir 70. The temperature sensor 54 may be configured to measure a temperature of the coolant in the expansion reservoir 70. In some examples, the temperature sensor 54 may be a part of the valve 74, and/or may be physically coupled to the valve 74. However, in other examples, the temperature sensor 54 may not be included in the valve 74, and may not be physically coupled to the valve 74, but may instead be coupled to an interior wall of the expansion reservoir 70. As such, the temperature sensor 54 may be positioned at the vertical bottom of the reservoir 70, so that it is submerged in coolant during engine operation.

Controller 21 may be configured as a microcomputer including a microprocessor unit, input/output ports, an electronic storage medium for executable programs and calibration values, random access memory, keep alive memory, and a data bus. Controller 21 may receive various signals from sensors 61 coupled to cooling system 10. As an example, controller 21 may receive signals from temperature sensor 54, positioned within the expansion reservoir 70 for estimating a temperature of the coolant in the expansion reservoir 70. Thus, the controller 21, may estimate a temperature of the coolant in the expansion reservoir 70 based on outputs from the temperature sensor 54. Furthermore, controller 21 may monitor and employ the use of various actuators 81 to adjust the position of various valves, for example valve 74, based on the received signals and instructions stored in the memory of the controller. The controller 21 may monitor coolant temperature, fuel flow rate, airflow rate, and engine knock information via the outputs of various sensors. Based upon these factors, the controller may determine the appropriate amount of coolant flow through the engine 20 and/or speed of the fans of the radiators 11 and 12 to maintain the coolant to within a desired temperature range. Storage medium read-only memory in controller 21 can be programmed with computer readable data representing instructions executable by a processor for performing the methods described below in combination with the engine system components described above (e.g., the various sensors and actuators), as well as other variants that are anticipated but not specifically listed. Example methods and routines are described herein with reference to FIG. 5. As one example, the controller, in combination with the above-described sensors and actuators of the system shown in FIG. 1, may execute the methods described further below with reference to FIG. 5.

Figure 3:
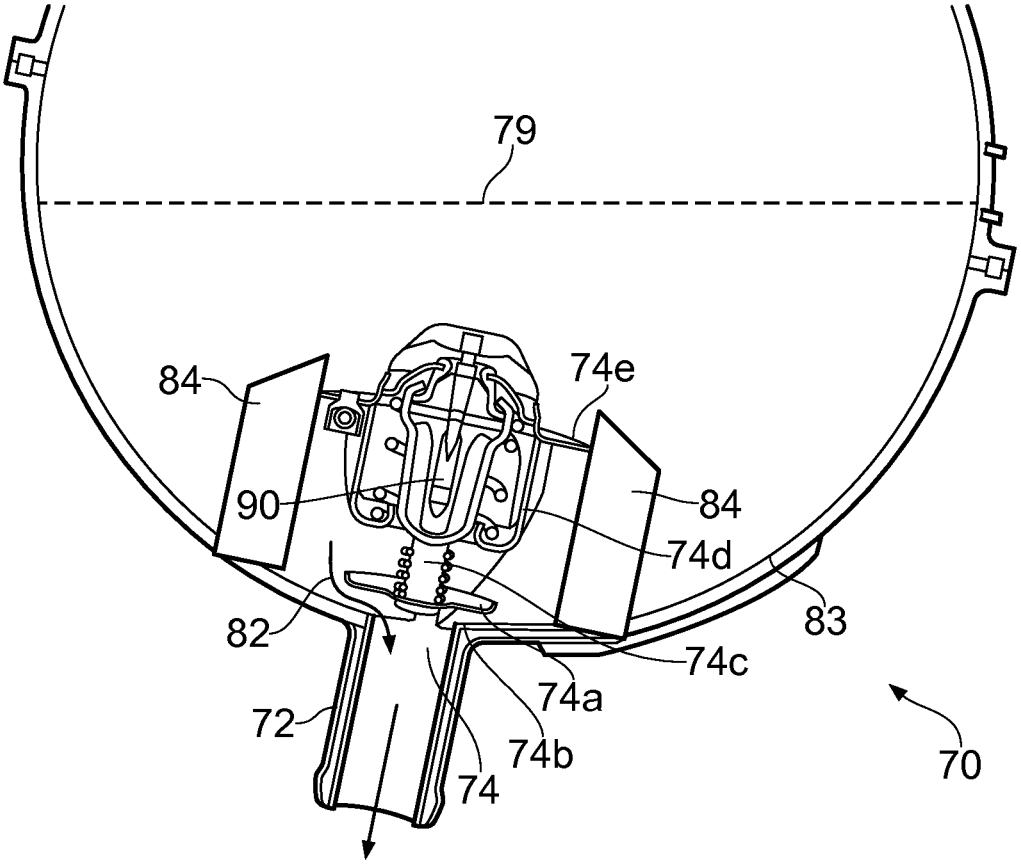
FIG. 3 is a side sectional view of the expansion reservoir of FIG. 2, with a valve of the expansion reservoir in an open position.
Figure 4:
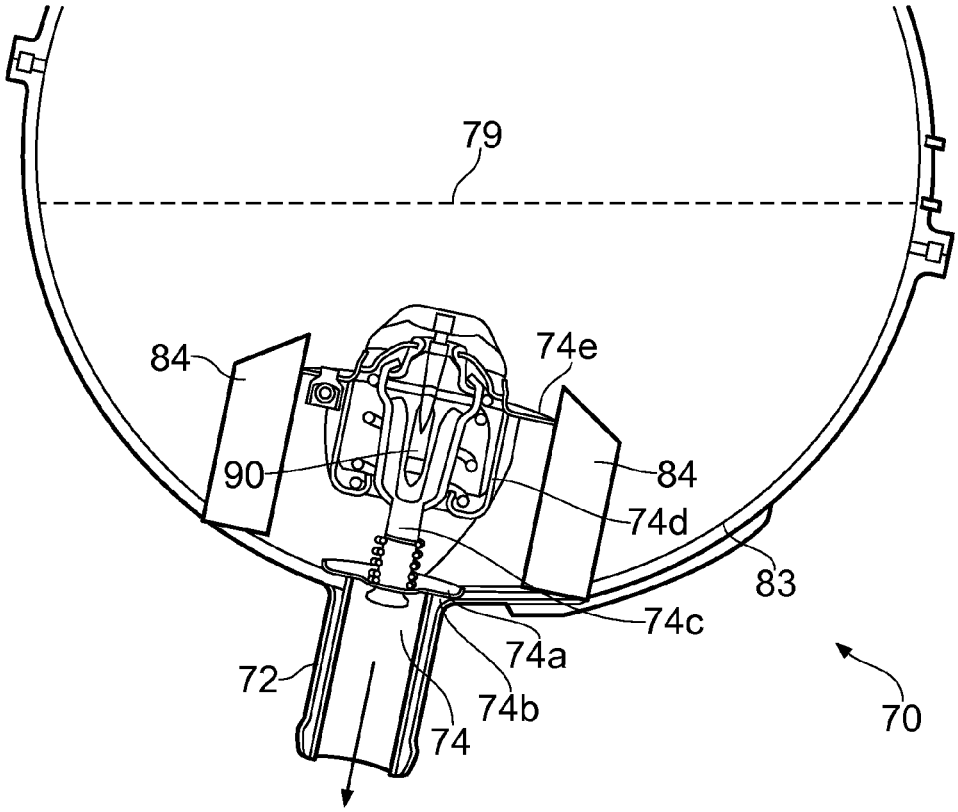
FIG. 4 is a side sectional view of the expansion reservoir of FIGS. 2 and 3, with the valve in a closed position.

Referring now to FIGS. 2 to 4, further details of the expansion reservoir 70 will be described. As depicted, the expansion reservoir 70 may be substantially spherical. However, it will be appreciated that the expansion reservoir 70 may be a different shape than spherical (e.g., such as cubed, cuboidal, cylindrical, etc.). The expansion reservoir 70 may comprise first and second portions 70*a*, 70*b* that may be joined, e.g. bonded or mechanically fixed, together to form the expansion reservoir. The first and second portions 70*a*, 70*b* may be joined at respective first and second rims 75*a*, 75*b*. Each of the first and second portions 70*a*, 70*b* may be substantially hemispherical. The first and second portions 70*a*, 70*b* may be moulded and may be made from a mouldable material such as plastic. Furthermore, the expansion reservoir may be at least partially made from a translucent or transparent material so that the level of the coolant may readily be monitored.

As shown in FIG. 2, the expansion reservoir 70 may comprise a fill inlet 73, which may be provided towards the top of the expansion vessel 70. Thus, the fill inlet 73 may be vertically above all other components of the expansion reservoir 70. As such, the fill inlet 73 may be positioned at the vertical top of the reservoir with respect to the ground when reservoir 70 is coupled in a vehicle. The fill inlet 73 may comprise a threaded portion 73' for receiving a cap (not shown). Furthermore, the expansion reservoir 70 may comprise a mounting point 78 for mounting the expansion reservoir to a vehicle sub-frame (not shown).

Referring still to FIG. 2, the expansion reservoir 70 comprises the first and second outlets 71, 72 for returning coolant to first and second cooling circuits, such as first and second cooling circuits 1, 2 respectively, shown above with reference to FIG. 1. In addition, the expansion reservoir 70 comprises first and second inlets 76, 77, which receive coolant from the first and second cooling circuits. For example, the first inlet 76 may receive coolant from the first radiator 11, as shown above with reference to FIG. 1, via the first flow path 15 and the second inlet 77 may receive coolant from the second radiator 12 via the second flow path 16. Coolant from the further outlet 42 may pass into the expansion reservoir 70 through either of the first and second inlets 76, 77 or through a further inlet (not shown). It will be appreciated that other inlet arrangements are also envisaged such as a common inlet for all sources of coolant into the expansion reservoir.

Referring now to FIGS. 3 and 4, the expansion reservoir 70 may comprise the valve 74, which may be positioned so as to selectively block the flow of coolant through the second outlet 72. The first and second outlets 71, 72 may be at or near the bottom of the expansion reservoir 70. Thus, the first and second outlets 71 and 72, may be vertically below all other components of the expansion reservoir 70. As such, the first and second outlets 71 and 72 may be positioned at the vertical bottom of the reservoir 70 with respect to the ground when reservoir 70 is coupled in a vehicle. Furthermore, the valve 74 may be arranged in the coolant reservoir 70 below a minimum coolant level 79 such that the valve 74 may always be immersed in coolant during use. In another example, the valve 74 may be positioned in reservoir 70 such that it is immersed in coolant only during a portion of engine use.

As depicted, the valve 74 may comprise a valve closure 74*a* and a valve seat 74*b*. The valve closure 74*a* may be configured to seal against the valve seat 74*b* when the valve 74 is in a closed position (as shown below with reference to FIG. 4). The valve closure 74*a* and/or valve seat 74*b* may comprise a seal for sealing against the other of the valve seat and valve closure. The valve seat 74*b* may be formed by an inner surface portion of the expansion reservoir 70, which is disposed about the second outlet 72. The valve closure and seat 74*a*, 74*b* may be substantially circular. Similarly, the second outlet 72 may also have a circular cross-section.

The valve 74 may comprise a shaft 74*c* connected to the valve closure 74*a*. The shaft 74*c* may be slidably disposed in a valve housing 74*d* such that the valve closure 74*a* may slide between open and closed positions as shown in FIGS. 3 and 4 respectively. The shaft 74*c* may be disposed out of a flow path 82 through the valve 74 and into the second outlet 72. For example, the shaft 74*c* may be provided vertically above the second outlet 72. Arranging the shaft 74*c* in this way maximises the flow area for flow path 82 and thereby minimises the pressure loss across the valve 74.

The expansion reservoir 70 may further comprise one or more mounts for mounting the valve 74 to an inner surface 83 of the expansion reservoir. For example, a mount 84 may be at least partially circumferentially disposed about the outlet 72. The mount 84 may protrude from the inner surface 83 of the expansion reservoir, e.g., in a substantially inward direction. For example, the mount may protrude from the inner surface 83 in a direction which may be substantially parallel to a longitudinal axis of valve shaft 74*c*. The mount 84 may be integral, e.g., unitary, with the expansion reservoir 70. For example, the mount 84 may be a moulded feature of the expansion reservoir 70, e.g., the first portion 70*a*.

The valve 74 may comprise a flange 74*e* which connects to the mount 84. The flange 74*e* may extend from the valve housing 74*d* to the mount 84. The flange 74*e* may comprise one or more openings to permit flow between the valve housing 74*d* and the mount 84.

The expansion reservoir 70 may further comprise a temperature sensor (e.g. temperature sensor 54 shown in FIG. 1)

arranged to sense the temperature of the coolant, e.g., in the expansion reservoir. In other examples, such as the particular example shown in FIGS. 3 and 4, the valve 74 may comprise a temperature sensing element 90. The temperature sensing element 90 may be arranged to be below the minimum coolant level 79 such that the temperature sensing element is in thermal communication with the coolant in use. The temperature sensing element 90 may be immersed in the coolant, such that the coolant may be free to flow around the temperature sensing element. The temperature sensing element 90 may be provided in the valve housing 74*d*. Coolant may be able to enter the valve housing 74*d* via one or more openings such that the temperature sensing element 90 is in thermal communication with the coolant.

The temperature sensing element 90 may be configured to open or close the valve 74 in response to the temperature of the coolant. In a particular example, the valve 74 may consist of a thermostatically controlled valve, e.g., which may automatically open or close in response to the surrounding temperature. The temperature sensing element 90 may be operatively connected to the valve closure 74*a*, for example via the valve shaft 74*c*. The temperature sensing element 90 may comprise a portion that reacts, e.g., expands, contracts or flexes, depending on the temperature of the coolant and such a portion may be configured to open and close the valve 74. For example, the temperature sensing element 90 may comprise a bimetallic strip that flexes in response to the surrounding temperature. The valve 74 may be adjustable, e.g., by adjusting the temperature sensing element 90, so that the valve activation temperature may be selected or any wear in the valve may be adjusted for.

In the particular example shown, the temperature sensing element 90 may comprise a fluid or solid that may expand or contract depending on the temperature, for example as the fluid or solid changes state. By way of example, the temperature sensing element 90 may comprise a wax. The wax may be held in a chamber within the valve 74. The wax may melt due to the increasing temperature of the coolant and as the wax melts it may expand. Expansion of the wax may directly or indirectly actuate the valve shaft 74*c* so as to close the valve. Furthermore, the valve closure 74*a* and/or shaft 74*c* may be resisted by a spring that returns the valve closure to the closed stated, e.g., once the wax has resolidified. Thus, the position of the valve may be adjusted from an open first position where coolant may flow through valve to a closed second position where coolant may not flow through the valve in response to coolant temperature at the valve increasing above a non-zero threshold.

The valve 74 described above may operate independently, e.g., of a control system or any other temperature sensor such that it is not actively controlled. However, in alternative arrangements a controller (such as controller 21 shown in FIG. 1) may be provided and the controller may be configured to activate the valve 74 depending on a sensed temperature of the coolant. As described above with reference to FIG. 1, the controller may be configured to monitor the temperature of the coolant in the first coolant circuit 1, the second coolant circuit 2 and/or the expansion reservoir 70 with one or more temperature sensors (such as temperature sensor 54 shown in FIG. 1) positioned within the expansion reservoir 70. In some examples, the one or more temperature sensors may be included in the heating element 90. However, in other examples, the one or more temperature sensors may be positioned external to the valve 74, and may be coupled to an interior wall of the expansion reservoir 70. The controller may also be configured to control the flow rate of the coolant in the first and/or second coolant circuits, for example by virtue of one or more valves (not shown) and/or the pumps 14, 30.

When the valve 74 is open, coolant from the first and second cooling circuits 1, 2 may mix via the common expansion reservoir 70 and thermal energy may be transferred may be transferred between the two cooling circuits. FIG. 3 shows the valve 74 in such a position. The valve 74 may be open when the engine 20 is idle and during assembly of the engine cooling system 10, for example to allow the first and second cooling circuits 1, 2 to be filled with coolant. As the engine 20 warms up the temperature of the coolant in the first cooling circuit 1 may remain low and thus the temperature difference between the coolant in the first and second cooling circuits 1, 2 may be small. Mixing between the first and second cooling circuits 1, 2 may therefore be tolerated during engine warm up and as such the valve 74 may remain open during warm up of the engine. Permitting coolant to flow from the expansion reservoir 70 to the second cooling circuit 2 during engine warm up and idle allows the coolant in the second coolant circuit to degas and expand into the expansion reservoir.

The valve 74 may start to close when the coolant in the expansion reservoir 70 reaches a first threshold temperature (e.g., approximately 50° C.). At such a temperature, the coolant in the first and second cooling circuits 1, 2 may start to diverge and a greater rate of heat transfer between the two cooling circuits may occur. Once the valve 74 starts to close it will restrict the flow of coolant from the expansion reservoir 70 to the second cooling circuit 2, thereby restricting the mixing between the two cooling circuits and reducing the heat transfer therebetween. The valve 74 may be fully closed when the coolant is at a second threshold temperature (e.g., approximately 60° C.). Once the valve 74 is fully closed the flow of coolant from the expansion reservoir 70 to the second cooling circuit 2 is prevented and FIG. 4 shows the valve in a closed position. The valve 74 may open (or start to open) again when the coolant drops below the second threshold temperature, for example after the engine has been switched off. A further opportunity for the coolant in the second cooling circuit 2 to degas is provided once the valve 74 begins to open.

In an alternative arrangement (not shown), a further valve may be arranged so as to selectively block the second inlet 77 to the expansion reservoir for the second cooling circuit 2. Such a further valve may be instead of or in addition to the valve 74. The further valve may be arranged and may operate in a similar fashion to that described for valve 74.

In a further alternative arrangement (not shown), the first inlet 76 and/or first outlet 71 for the first cooling circuit 1 may be provided with a valve. Such valves may be arranged and may operate in a similar fashion to that described for valve 74. In other words, such valves may selectively isolate the first cooling circuit 1 from the second cooling circuit 2 depending on the temperature of the coolant. Furthermore, the valve(s) of the further alternative arrangement may be provided instead of or in addition to the alternative arrangement described in the preceding paragraph or the valve 74 for second outlet 72 described above.

In this way, a system for an engine cooling system may comprise first and second cooling circuits, in fluidic communication with an expansion reservoir. The first and second cooling circuits may each comprise a radiator for cooling coolant flowing through the circuits. Coolant in the second cooling circuit may be cooled to a lower temperature than coolant in the first cooling circuit. Fluidic communication between the second cooling and the expansion reservoir may be restricted when the temperature of coolant in the expansion reservoir increases above a threshold. Thus, fluidic communication and therefore heat transfer between the first and second cooling circuits may be reduced or completely restricted when coolant temperatures in the expansion reservoir exceed a threshold.

The flow of coolant between the expansion reservoir and the second cooling circuit may be restricted by adjusting the position of a valve positioned in a flow path between the expansion reservoir and the second cooling circuit. Specifically, the position of the valve may be adjusted between a first position where coolant flows between the expansion reservoir and the second cooling circuit and a second position where coolant does not flow between the expansion reservoir and the second cooling circuit. The first and second positions may be referred to as "open" and "closed" positions, respectively. In the open position, coolant may flow between the expansion reservoir and the second cooling circuit, however, in the closed position, coolant flow may be restricted between the expansion reservoir and the second cooling circuit. In one example, the valve may be positioned at an inlet of the expansion reservoir, and may thus, regulate the flow of coolant from the second cooling circuit to the expansion reservoir. In another example the valve may be positioned at an outlet of the expansion reservoir, and may thus, regulate the flow of coolant from the expansion reservoir to the second cooling circuit. In still further examples, valves may be positioned at both the inlet and outlet of the expansion reservoir for regulating both the flow of coolant to the expansion reservoir from the second cooling circuit, and from the expansions reservoir to the second cooling circuit.

In one embodiment, the one or more valves in the expansion reservoir may be passively controlled and as such may comprise a temperature sensitive element. As an example, the temperature sensitive element may be a wax element. The temperature sensitive element may cause the position of the valve to be adjusted to the closed position in response to the temperature of the coolant exceeding the threshold.

In another embodiment, the position of the one or more valves in the expansion reservoir may be controlled by a controller. As such, the controller may send electrical signals to one or more actuators for adjusting the position of the one or more valves based on a temperature of coolant in the expansion reservoir. The temperature of the coolant may be estimated based on outputs of a temperature sensor positioned in the expansions reservoir for sensing the coolant temperature. Further, the controller may send signals to the one or more actuators for adjusting the position of the one or more valves to the closed position in response to the sensed temperature of the coolant exceeding a threshold. Thus, the controller may restrict the flow of coolant between the second cooling circuit and the expansion reservoir, and therefore the fluidic communication and thermal transfer between the first and second cooling circuits.

The valves may be open during assembly of the engine cooling system, for example to allow the cooling system to be filled with coolant. The valves may also be open during warm up of the engine. The valves may close (or start to close) once the coolant has reached the predetermined temperature. The valves may open (or finish opening) again when the coolant goes below the predetermined temperature, e.g. after the engine has been switched off.

In another example, the expansion reservoir may be a separate component from other components in the first and second cooling circuits, such as radiators, engine, coolant pump and heat exchangers. The expansion reservoir may be provided at the highest point in the cooling circuits.

In further examples, the expansion reservoir may comprise an outlet port for the second cooling circuit. One of the valves of the expansion reservoir may be arranged so as to selectively block the outlet port for the second cooling circuit. For example, one of the valves may be provided in, adjacent to, or upstream of the outlet port.

The expansion reservoir may comprise an inlet port for the second cooling circuit. One of the valves may be arranged so as to selectively block the inlet port for the second cooling circuit. For example, one of the valves may be provided in, adjacent to or downstream of the inlet port.

The second coolant circuit may be configured to operate with coolant at a lower temperature than the first coolant circuit. Alternatively, the second coolant circuit may be configured to operate with coolant at a higher temperature than the first coolant circuit.

The valves may comprise a valve closure and a valve seat. The valve closure and valve seat may be provided at the inlet port and/or outlet port.

The expansion reservoir may comprise first and second outlet ports for the first and second cooling circuits respectively. Similarly, the expansion reservoir may comprise first and second inlet ports for the first and second cooling circuits respectively.

Each of the inlet and outlet ports for the first and second cooling circuits may be provided with a valve. However, only the inlet and/or outlet ports for the second cooling circuit may be provided with such valves. In a particular example, only the outlet port for the second cooling circuit may be provided with a valve. In an alternative example, only the inlet port for the second cooling circuit is provided with a valve.

The valves may be operable to restrict, e.g., prevent, flow of coolant from the second cooling circuit to the expansion reservoir and/or from the expansion reservoir to the second cooling circuit when the coolant, e.g., in the expansion reservoir, is above a threshold temperature. The valves may start to close at a first threshold temperature. The valves may be fully closed at a second threshold temperature.

The valves may be arranged in the expansion reservoir so as to be immersed in coolant during use. For example, a valve may be provided in one of the outlet ports, which may be at or towards the bottom of the expansion reservoir.

The expansion reservoir may further comprise a temperature sensor. The temperature sensor may be arranged to sense the temperature of the coolant, e.g., in the expansion reservoir. For example, the valves may comprise a temperature sensing element. The temperature sensing element may be configured to open or close the valves in response to the temperature of the coolant, e.g., in the expansion reservoir. In a particular example, the valves may comprise a thermostatically controlled valve, e.g., which may automatically open or close in response to the surrounding coolant temperature.

Figure 5:
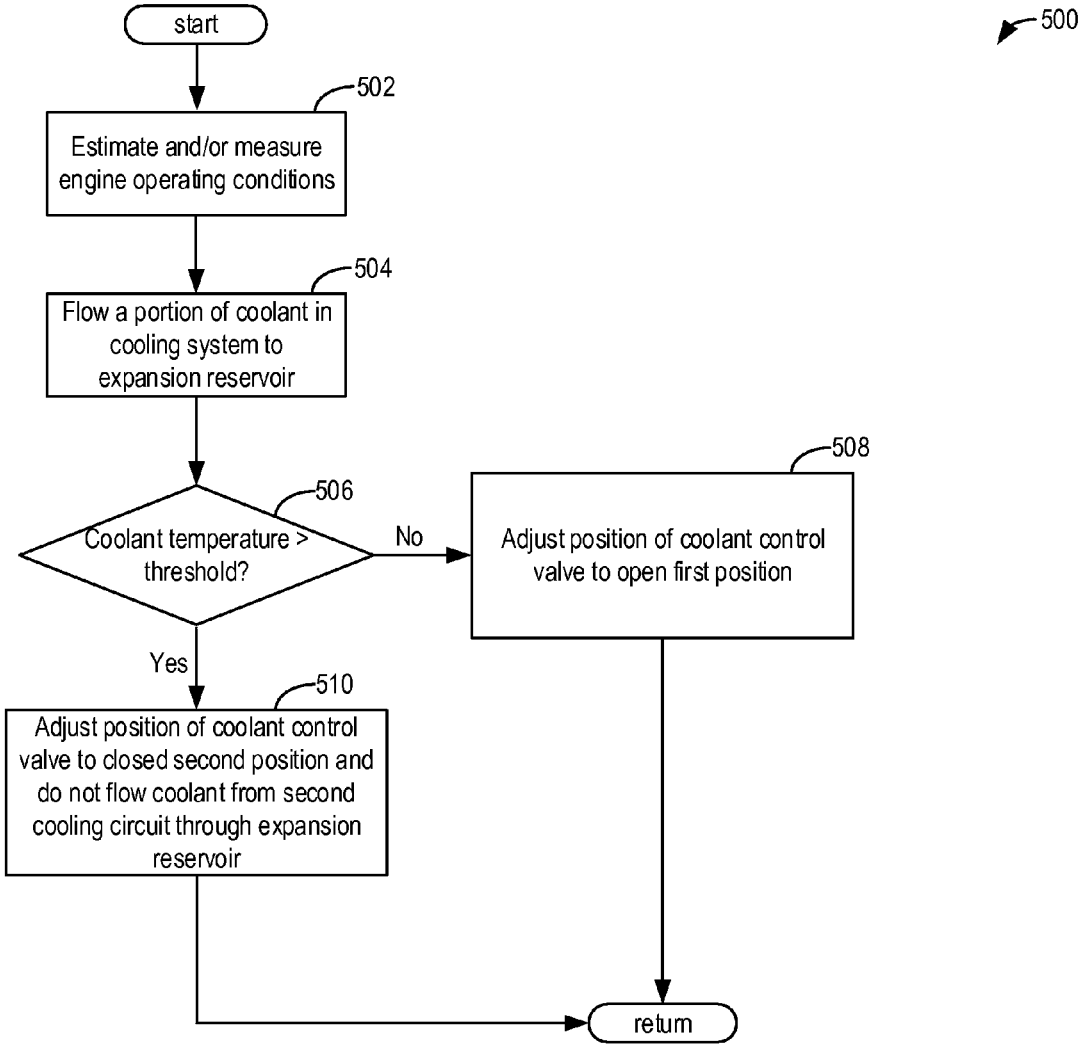
FIG. 5 is a flow chart of an example method for regulating the flow of coolant in an engine cooling system.

Turning now to FIG. 5, it shows a flow chart of an example method 500 for regulating the flow of coolant in an engine cooling system, such as engine cooling system 10 from FIG. 1. Specifically, method 500 may be used for regulating a flow of coolant between a first and second cooling circuit (e.g., first cooling circuit 1 and second cooling circuit 2 from FIG. 1), and an expansion reservoir (e.g., expansion reservoir 70 from FIG. 1). Instructions for executing method 500 may be stored in the memory of a controller (e.g., control 12 from FIG. 1), and as such may be executed by the controller in combination with the various sensors and actuators of an engine cooling system (such as the engine coolant system 10 shown in FIG. 1). Specifically, the controller may receive signals from various sensors in the cooling system. In response to received signals, the controller may execute method 500, which may involve sending electrical signals to various actuators to adjust the position of one or more valves in the cooling system (e.g., valve 74 from FIG. 1). Thus, in the description of method 500 herein, when the method 500 comprises adjusting the position of a valve, the method 500 may include sending signals from the controller to an actuator of the respective valve, the actuator capable of adjusting a position of the valve. Additionally, the controller may send signals to other actuators to adjust the speed of and/or power supplied to one or more of a fan of a radiator (e.g., first radiator 11 and second radiator 12 from FIG. 1), water pump (e.g., pumps 14 and 30 from FIG. 1), etc. Thus, in some examples, method 500 may be executed by controller 21 from FIG. 1. In alternate embodiments, as explained below, the valve adjusting the flow of coolant between the expansion reservoir and the second cooling circuit may be passively controlled responsive to coolant temperature and not controlled via an electronic controller. As such, portions of method 500 may be controlled passively responsive to coolant temperature.

Method 500 begins at 502, which comprises estimating and/or measuring engine operating conditions. Engine operating conditions may include one or more of: engine speed, engine load, engine temperature, coolant temperature, radiator fan speed, power provided to a water pump, radiator pressure, etc. Based on the estimated and/or measured engine operating conditions at 502, method 500 continues to 504 and flows a portion of coolant in the cooling system through the expansion reservoir. Specifically, the method at 504 may include flowing a portion of coolant in the second cooling circuit to the expansion reservoir. In another example, the method at 504 may alternatively include flowing a portion of coolant in the first cooling circuit to the expansion reservoir. In a further example, the method at 504 may include flowing a portion of coolant from both the first and second cooling circuits to the expansion reservoir.

Method 500 then continues from 504 to 506 which comprises determining if the coolant temperature is greater than a threshold. The temperature of the coolant may be estimated based on outputs from a temperature sensor positioned in the expansion reservoir and in electrical communication with the controller. The threshold may be a threshold temperature based on a desired coolant temperature in the second cooling circuit. Since the desired coolant temperature in the second cooling circuit may be lower than that of the first cooling circuit, it may be desired to limit fluidic and therefore thermal communication between the two cooling circuits, if the temperature of the coolant in the first cooling circuit exceeds the desired coolant temperature of the second cooling circuit. Therefore, the threshold may represent a maximum desired coolant temperature for coolant in the second cooling circuit.

If the temperature of coolant in the expansion reservoir is determined to be below the threshold at 506, then method 500 continues to 508, which comprises adjusting the position of a coolant control valve (e.g., valve 74 from FIG. 1) to an open first position and flowing coolant from the second cooling circuit through the expansion reservoir. If the valve is already in the first position at 508, then method 500 may comprise maintaining the valve in the first position at 508. The open first position may include a position of the valve, where coolant flows between the expansions reservoir and the second cooling circuit. As such, when the valve is in the open first position, there may be unrestricted fluidic communication between the expansion reservoir and the second cooling circuit. Additionally, the method 500 at 508 may comprise flowing coolant from the expansion reservoir to the second cooling circuit. Thus, the method 500 at 508 comprises adjusting the position of the coolant control valve to an open first position to allow fluidic communication between the expansion reservoir and the second cooling circuit.

The method 500 at 508 may additionally comprise flowing coolant from the first cooling circuit through the expansion reservoir. Thus, the method 500 at 508 may include flowing coolant from both the first and second cooling circuits through the expansion reservoir. As such, coolant from both the first and second cooling circuits may interact with one another and mix in the expansion reservoir at 508. Method 500 then returns.

However, if it is determined at 506 that the coolant temperature is above the threshold, then method 500 continues to 510, which comprises adjusting the position of the coolant control valve to a closed second position and not flowing coolant from the second cooling circuit through the expansion reservoir. If the coolant control valve is already in the second closed position at 510, then method 500 may comprise maintaining the valve in the second closed position at 510. The second closed position of the valve may be a position of the valve where coolant does not flow between the second cooling circuit and the expansion reservoir. As such, in the second closed position, the valve may restrict coolant flow between the second cooling circuit and the expansion reservoir. Therefore, at 510, coolant may only flow between the expansion reservoir and the first cooling circuit. Thus, the method at 510 may include only flowing coolant from the first cooling circuit through the expansion reservoir, and not flowing coolant from the second cooling circuit through the expansion reservoir when the valve is in the closed second position. As such, the mixing of coolant from the second reservoir and first reservoir in the expansion reservoir may be reduced or completely restricted at 510.

In one example, the valve may be positioned at a second cooling circuit inlet of the expansion reservoir (e.g., second inlet 77 shown in FIG. 2) in fluidic communication with the expansion reservoir and the second cooling circuit. The inlet is configured to receive coolant from the second cooling circuit. As such, the valve may regulate the flow of coolant from the second cooling circuit into the expansion reservoir. Therefore, in examples where the valve is positioned at the second cooling circuit inlet, the adjusting of the valve to the closed second position at 510, may include completely restricting the flow of coolant from the second cooling circuit to the expansion reservoir. In this way coolant may only flow to the expansion reservoir from the first cooling circuit. However, in such examples, coolant may still flow from the expansion reservoir to both the first and second cooling circuits.

In another example, the valve may be positioned at an outlet of the expansion reservoir (e.g., second expansion reservoir outlet 72 shown in FIG. 1), where the outlet is in fluidic communication with the expansion reservoir and the second cooling circuit. The outlet is configured to flow coolant out from the expansion reservoir to the second cooling circuit. As such, in example where the valve is positioned in the outlet, the valve may regulate the flow of coolant from the expansion reservoir to the second cooling circuit. Therefore, in examples where the valve is positioned at the outlet, the adjusting of the valve to the closed second position at 510 may include completely restricting the flow of coolant from the expansion reservoir to the second cooling circuit. Said another way, the method 500 at 510 may include only flowing coolant from the expansion reservoir to the first cooling circuit, and not flowing coolant from the expansion reservoir to the second cooling circuit. However, coolant may still flow from one or more of the first and second cooling circuits to the expansion reservoir, but may only flow from the expansion reservoir to the first cooling circuit and not the second cooling circuit.

In a further example, two valves may be positioned in the expansion reservoir, one at the inlet, and the other at the outlet. In such examples, the method 500 at 510 may include adjusting the position of both of the valves to their closed second positions and not flowing coolant between the expansion reservoir and the second cooling circuit. In this way all fluidic communication between the expansion reservoir and the second cooling circuit may be restricted. As such, fluidic communication between and therefore thermal transfer between the first and second cooling circuits may be reduced and/or restricted at 510. Said another way, because only coolant from the first cooling circuit may be flowing to the expansion reservoir at 510, the mixing of coolant from the first and second cooling circuits in the expansion reservoir may be reduced and/or completely restricted. Method 500 then returns.

In this way, an engine cooling system may comprise a first cooling circuit and a second cooling circuit. The second cooling circuit may be configured to operate at a different temperature than the first cooling circuit. The engine cooling system may further comprise the above-mentioned expansion reservoir.

The engine cooling system may further comprise a controller and one or more temperature sensors configured to monitor the temperature of the coolant. The controller may be configured to activate the valve depending on the sensed temperature of the coolant.

The engine cooling system may further comprise a first radiator for cooling the coolant in the first cooling circuit and a second radiator for cooling the coolant in the second cooling circuit. The first radiator may cool the coolant to a first temperature and the second radiator may cool the coolant to a second temperature. The second temperature may be different from the first temperature. In particular, the second temperature may be lower than the first temperature.

The engine cooling system may further comprise a charge air cooler. The charge air cooler may be arranged in the second cooling circuit such that the charge air may be cooled by coolant from the second radiator.

An engine, such as an internal combustion engine, or a vehicle, such as a motor vehicle, may comprise the above-mentioned expansion reservoir and/or the above-mentioned engine cooling system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An expansion reservoir for an engine cooling system, the cooling system comprising a first cooling circuit and a second cooling circuit, the second cooling circuit including a second radiator configured to cool coolant to a lower temperature than a first radiator of the first cooling circuit, wherein the expansion reservoir is configured to receive coolant from and return coolant to each of the first and second cooling circuits, and wherein the expansion reservoir comprises one or more valves arranged so as to restrict a flow of coolant from one or more of the second cooling circuit to the expansion reservoir and from the expansion reservoir to the second cooling circuit in response to a temperature of the coolant in the expansion reservoir being greater than a predetermined temperature.

2. The expansion reservoir of claim 1, wherein the one or more valves comprise a valve closure and a valve seat, the valve closure and valve seat being provided at respective ports.

3. The expansion reservoir of claim 1, wherein the one or more valves are operable to block the flow of coolant from one or more of the second cooling circuit to the expansion reservoir and from the expansion reservoir to the second cooling circuit when coolant in the expansion reservoir is above the predetermined temperature and not block the flow of coolant from one or more of the second cooling circuit to the expansion reservoir and from the expansion reservoir to the second cooling circuit when coolant in the expansion reservoir is below the predetermined temperature.

4. The expansion reservoir of claim 1, wherein the one or more valves comprise a temperature sensing element, the temperature sensing element being configured to open the one or more valves in response to the temperature of the coolant being below the predetermined temperature and close the one or more valves in response to the temperature of the coolant being above the predetermined temperature.

5. The expansion reservoir of claim 1, wherein the first cooling circuit further includes a cabin heater and the second cooling circuit further includes a charge air cooler.

6. The expansion reservoir of claim 1, wherein the expansion reservoir comprises a first inlet that receives coolant from the first cooling circuit and a first outlet that returns coolant from the expansion reservoir to the first cooling circuit, where the first inlet and first outlet are not fluidly coupled with the one or more valves.

7. The expansion reservoir of claim 6, wherein the expansion reservoir comprises a second outlet for the second cooling circuit that returns coolant from the expansion reservoir to the second cooling circuit and one of the one or more valves is arranged so as to selectively block the second outlet for the second cooling circuit and wherein flow through the expansion reservoir from the first inlet to the first outlet is not selectively blocked by the one or more valves.

8. The expansion reservoir of claim 7, wherein the one or more valves are arranged so as to be immersed in coolant during use and wherein the first outlet and second outlet are positioned at a vertical bottom of the expansion reservoir with respect to ground when the expansion reservoir is coupled in a vehicle including the engine cooling system.

9. The expansion reservoir of claim 7, wherein the expansion reservoir further comprises a temperature sensor, the temperature sensor being arranged to sense the temperature of the coolant, wherein the second outlet returns coolant to the second cooling circuit, downstream of the second radiator and upstream of an electric pump and a charge air cooler disposed in the second cooling circuit, and wherein the first outlet returns coolant to a crankshaft driven pump of the first cooling circuit, downstream of the first radiator.

10. The expansion reservoir of claim 6, wherein the expansion reservoir comprises a second inlet for the second cooling circuit and one of the one or more valves is arranged so as to selectively block the second inlet for the second cooling circuit.

11. The expansion reservoir of claim 6, wherein the expansion reservoir comprises a second inlet that receives coolant from the second cooling circuit and a second outlet that returns coolant from the expansion reservoir to the second cooling circuit and wherein the one or more valves are arranged at and fluidly coupled to only one of the second inlet and the second outlet.

12. An engine cooling system comprising:

a first cooling circuit comprising a first radiator for cooling coolant to a first temperature;

a second cooling circuit comprising a second radiator for cooling coolant to a second temperature, lower than the first temperature; and an expansion reservoir in fluidic communication with the first cooling circuit and in selective fluidic communication with the second cooling circuit via a valve, where the valve is not fluidly coupled with the first cooling circuit and is adapted to block coolant flow between the second cooling circuit and the expansion reservoir in response to a coolant temperature in the expansion reservoir increasing above a non-zero threshold.

13. The engine cooling system of claim 12, wherein the valve is adjustable between a first position in which coolant flows between the second cooling circuit and the expansion reservoir and a second position in which coolant does not flow between the second cooling circuit and the expansion reservoir.

14. The engine cooling system of claim 13, wherein the valve is a passive wax thermostat valve, wherein a position of the valve is adjusted from the first position to the second position in response to coolant temperature at the valve increasing above the non-zero threshold.

15. The engine cooling system of claim 12, further comprising a controller with computer readable instructions for adjusting a position of the valve based on the coolant temperature in the expansion reservoir, where the coolant temperature is estimated based on outputs of a temperature sensor positioned in the expansion reservoir, and wherein a first inlet into the expansion reservoir from the first cooling circuit is arranged downstream of the first radiator and a second inlet into the expansion reservoir from the second cooling circuit is arranged downstream of the second radiator.

16. The engine cooling system of claim 12, further comprising a first outlet for flowing coolant from the expansion reservoir to only the first cooling circuit, and a second outlet for flowing coolant from the expansion reservoir to only the second cooling circuit, wherein the valve is positioned at the second outlet for regulating the flow of coolant from the expansion reservoir to the second cooling circuit, and wherein the valve is not fluidly coupled to the first outlet.

17. The engine cooling system of claim 12, wherein the engine cooling system further comprises a charge air cooler which is arranged in the second cooling circuit such that charge air is cooled by coolant from the second radiator, and wherein the engine cooling system further comprises a cabin heater arranged in the first cooling circuit.

18. A method, comprising:

flowing at least a portion of coolant between a first cooling circuit and an expansion reservoir of an engine cooling system;

cooling coolant in a second cooling circuit to a lower temperature than coolant in the first cooling circuit;

adjusting a position of a coolant control valve positioned in the expansion reservoir to a first position to flow coolant between the second cooling circuit and the expansion reservoir in response to a coolant temperature in the expansion reservoir being below a threshold; and adjusting the position of the coolant control valve to a second position to block coolant flow between the second cooling circuit and the expansion reservoir in response to the coolant temperature being at or above the threshold.

19. The method of claim 18, wherein the adjusting the position of the coolant control valve is performed via an electronic controller responsive to a temperature of the coolant estimated based on an output from a temperature sensor positioned in the expansion reservoir.

20. The method of claim 18, wherein the first cooling circuit includes a cabin heater and the second cooling circuit includes a charge air cooler.

* * * * *